United States Patent [19]

Culjković

[11] 3,984,292

[45] Oct. 5, 1976

[54] CYANIDE FREE BATH FOR ELECTRODEPOSITION OF SILVER

[75] Inventor: Josif Culjković, Berlin, Germany

[73] Assignee: Schering Aktiengesellschaft, Berlin & Bergkamen, Germany

[22] Filed: Jan. 23, 1975

[21] Appl. No.: 543,206

[30] Foreign Application Priority Data

Mar. 1, 1974 Germany ..... 2410441

[52] U.S. Cl. ..... 204/46 R

[51] Int. Cl.[2] ..... C25D 3/46

[58] Field of Search ..... 204/46 R, 109

[56] References Cited

UNITED STATES PATENTS 1,857,507 5/1932 Hickman et al. ..... 204/46 R

*Primary Examiner*—G. L. Kaplan

*Attorney, Agent, or Firm*—Joseph & Pudlon

[57] ABSTRACT

The specification discloses an improvement in the electrodeposition of silver from an aqueous cyanide-free bath which comprises the use organic nitrogen containing compounds having at least two nitrogen atoms and having a molecular weight of at least 300, and a compound of sulfur or selenium in which the sulfur or selenium is in an oxidation state of minus one or minus two. The combination is used as an activator in the bath.

3 Claims, No Drawings

CYANIDE FREE BATH FOR ELECTRODEPOSITION OF SILVER

Cyanide-free aqueous baths for electrodepositing silver coatings are provided. Such baths have thiosulfate solutions of silver.

The invention relates to a cyanide-free aqueous bath for the electrodeposition of silver coatings.

Alkali cyanide bright silver baths have long been known. But, because of their high toxicity, there is a need for less poisonous baths. The cyanide-free electrolytes proposed until now in this connection have, however, found no application in the practice because of the following disadvantages: their instability, their economic inefficiency or the inferior properties of the resultant coatings deposited therefrom. The electrolytic deposition of silver from cyanide-free thiosulfate solutions is also known (See *Elektrochemie*, Vol. 45, No. 10 (1939), pp. 757–759). Such solutions, containing silver chloride and sodium thiosulfate, have also proved unsatisfactory for the deposition of bright silver, and could not be improved substantially by the addition of cyanide, phosphate, turkey-red oil or other capillary-active substances and colloids. Also, changing the silver or thiosulfate content or the pH value had no basically improving effect; but even led to inferior coatings, to passivation of the anodes, or to accelerated decomposition.

It is, therefore, the object of the present invention to develop a cyanide-free, thiosulfate containing silver bath which avoids the disadvantages of the known baths and permits the electrodeposition of bright silver coatings having good mechanical and electrical properties without passivation of the anodes and which are extremely stable.

This is achieved, according to the invention, by a cyanide-free aqueous bath containing as essential constituents a silver compound and a thiosulfate and optionally conventional bath constituents, and which is characterized in that it contains additionally at least one organic nitrogen compound with at least two N atoms and a molecular weight of over 300, a sulfur or selenium compound of the oxidation degrees "minus one" or "minus two" respectively, or mixtures thereof.

As bath there is preferably used an aqueous thiosulfate solution which contains soluble silver or silver-complex compounds. Such soluble silver compounds are, for example, silver sulfate, nitrate, chloride, bromide, cyanide, thiocyanate, oxide, carbonate, sulfamate, acetate, and nitrate. The soluble silver complex compounds are, for example, the alkali silver cyanides such as $KAg(CN)_2$, alkali silver thiocyanate such as $K_2Ag(SCN)_3$ or $K_3Ag(SCN)_4$; alkali silver sulfites, such as $Na_3Ag(SO_3)_2$, or silver complexes with nitrogen-containing compounds, for example, ammonia, amines or polyamines. It has been found to be particularly favorable to add the silver to the bath in the form of its preformed thiosulfate complexes, for example, $Na_3Ag(S_2O_3)_2$, $Na_4Ag_2(S_2O_3)_3$. Alternatively, the thiosulfate may be added to the bath directly in the form of its ammonium and/or alkali salts, such as the sodium and potassium salts, or of its adducts of thiosulfuric acid or thiosulfuric ion with basic compounds, for example, the amines or the polyamines.

The production of the mentioned complex compounds may occur in a well known manner. Thus, $Na_3Ag(S_2O_3)_2$ can be produced by reacting, for example, as ammoniacal silver nitrate solution with sodium thiosulfate and precipitating the formed complex with potassium nitrate and alcohol. The use of small proportions of cyanide-containing salts is possible without disadvantage in the bath according to the present invention because due to the relatively high thiosulfate content a conversion soon takes place with the formation of thiocyanates.

The concentration of the silver in the bath may be from 0.5 g to 60 g/l, preferably 20 g to 40 g/l bath liquid. It has proved advantageous if the molar ratio of silver to thiosulfate referred to their ions $Ag^+$ and $S_2O_3^{2-}$ is at least 1:3, preferably 1:4 to 1:6. The quantity of thiosulfate ions, e.g. in the form of $Na_2S_2O_3.5H_2O$ may then be, for example, 4 to 800 g/l, preferably 180 to 550 g/l bath liquid. The pH value of the bath may be between 5 and 14, preferably between 7 and 11, and is adjusted to the desired value in the usual manner.

Suitable, as additions to be used according to the invention, are particularly the characterized nitrogen-containing organic compounds with at least two N atoms and a molecular weight of over 300.

Such nitrogen compounds are, for example, polyamines, namely polyethylene polyamine and other N-containing poly-molecules, which may be linear as well as branched. These compounds are known or can be produced by methods known in the art, for example, by polymerization of polyethylenimine, polypropylenimine or by polyaminoalkylation of ammonia or of primary or secondary amines. Especially suitable are nitrogen compounds whose molecular weights are from about 300 to over 50,000, preferably from 500 to 20,000. A very good effect show those soluble polynitrogen compounds used which are formed by the reactions well known of epihalohydrins (glycerin dichlorohydrin) with ammonia, amines or polyamines.

As starting products for the production of these compounds there are used those nitrogen compounds which have at least one amino group, such as ethylene diamine, tetraethylene pentamine, propylene diamine, N,N-dimethyl aminopropylene, N(n-butyl)-propanediamine-1,3, dipropylene triamine, gamma, gamma-diaminopropylthio ether, N,N-bis-(4-hydroxybutyrul)-dipropylene triamine, tetramethylene-diamine, hexamethylene diamine, N-(1,6-hexanediamine)-3-pyrrolidone, spermine, 4,4'-dipiperidyl, aminopyridine, hexamethylenetetramine and polyimines.

Other nitrogen compounds to be used according to the invention are heterocyclic compounds, for example polyvinyl-2-pyridine and polyvinyl-4-pyridine, as well as quaternary polyammonium compounds, which also are well known or which can be produced by well known methods, such as by conversion of the above named compounds with quaternizing agents, namely alkyl halides, alkylene halides, alkyl sulfates, esters of arylsulfonates or epihalohydrine.

Another possibility for the production of quaternary polyammonium compounds to be used according to the invention is offered by the reaction of alkylene halides with amines or polyamines, such as the reaction of 1,4-dichlorobutane with tetramethylethylene diamine. Also, the nitrogen compounds may be added in the form of betaines or sulfobetaines or in the form of ethoxylated compounds.

It has been found, furthermore, that in addition to these nitrogen-containing compounds certain sulfur and/or selenium compounds furnish excellently bright and ductile silver coatings. Sulfur or selenium compounds very suitable, in particular, are those in which the sulfur or selenium has the oxidation degree of "minus one" or "minus two."

By oxidation degree must be understood the so-called oxidation number or charge value, i.e., that charge which an atom would have in a molecule if the latter were composed of ions only.

Suitable compounds having these oxidation degrees are, for instance, those of the general formulas:

I. Compounds of the general formula $$R_1 - X_1 - X_2 - R_2$$

where $R_1$ and $R_2$ are identical or different and represent hydrogen, a univalent metal equivalent or an organic radical, $R_2$ being in addition, the groups —CN or —$SO_3Me$, and $X_1$ and $X_2$ are identical or different and represent a sulfur or selenium atom, and Me is a metal atom.

II. Compounds of the general formula $$R_1' - X - R_2'$$

where $R_1'$ and $R_2'$ are identical or different and represent hydrogen, a univalent metal equivalent or an organic radical, $R_2'$ represents in addition the groups —CN or $SO_3Me$, and X is a sulfur or selenium atom and Me a metal atom.

III. Compounds of the general formula

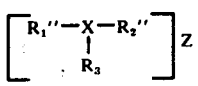

where $R_1''$ and $R_2''$ are identical or different and represent a univalent metal equivalent or an organic radical, $R_1''$ is in addition hydrogen, $R_3$ an organic radical, X a sulfur or selenium atom, and Z an acid radical.

IV. Compounds of the general formula

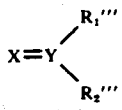

where $R_1'''$ and $R_2'''$ are identical or different and represent an organic radical, X is a sulfur or selenium atom and Y a non-metal atom.

It should be noted that the metallic disulfides and diselenides, where $R_1$ and $R_2$ represent a metal atom, are predominantly ionogenic, so that the formula should more correctly be written, for example, as $$R_1R_2X_2$$

or as $$R_1^+R_2^+(X-Y)^{--}$$

but this is known to the specialist.

As univalent metal equivalents enter into consideration herein, for example, Na, K, or Ca/2, etc.; organic radicals that may be named, are aliphatic, aromatic, cycloaliphatic and araliphatic radicals, which may optionally also be substituted and/or interrupted by one or more hetero atoms, such as oxygen, nitrogen or sulfur, and/or one or more hetero atom groups, such as $$>S=O$$

or

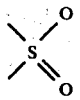

as well as the aracyl radical and the CN group.

Substituents for said organic radicals are, for example, halogen atoms, as chlorine, bromine, etc., hydroxyl radicals, alkyl radicals, as methyl and ethyl etc., aryloxy radicals, as phenoxy, etc., acyloxy radicals, as acetoxy, etc., the nitro and cyano group, the carboxy and sulfonic acid group in free or functionally modified form, e.g., as esters, or as salts, heterocyclic radicals, as tetrahydrofuryl, etc., as well as the radicals $$H_2N - CO - NH - CO -$$

or $$Ar - NH - CO -$$

For the onium compounds, the usual acid radicals of the onium compounds may be used, such as the inorganic acids, preferably of hydrohalic acids.

Compounds to be used according to the invention are the following:

| | |
|---|---|
| $CH_3-CH_2-S-S-CH_2-CH_3$ | Diethyl disulfane |
| $CH_3-S-Se-CH_2-CH_2-CH_3$ | Methyl propylselenosulfane |
| $K_2Se_2$ | Potassium diselenide |
| $(p\text{-}DO_3S-C_6H_4-)_2-Se_2$ | Bis(p-potassium-sulfophenyl) diselenane |
| KSeCN | Potassium selenocyanate |
| $C_6H_5-CH_2-SeSO_3K$ | Potassium benzylselenofulfonate |
| $CH_3-CH_2-CH_2-SeCN$ | propyl selenocyanate |
| 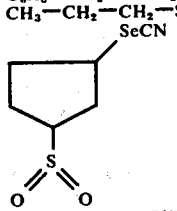 | Sulfolane selenocyanate |
| $(C_6H_5-CH_2-)_3S^+Br$ | Tribenzylsulfonium bromide |
| $(C_2H_5)_3Se^+Br^-$ | Triethyl selenonium bromide |
| $(HOOC-CH_2-S-CH_2-)_2$ | 2,5-dithiahexane-1,6-dicarboxylic acid |

-continued

| | |
|---|---|
| $(HOOC-CH_2-CH_2-S-CH_2-)_2$ | 3,6-dithiooctane-1,8-dicarboxylic acid |
| $(HO_3S-CH_2-CH_2-CH_2-S-C_2H_2O-)_2$ | 4,7-dithiadecane-1,10-disulfonic acid |
| $(HOOC-CH_2-S-CH_2-)_2CH_2$ | 2,6-dithiaheptane-1,7-dicarboxylic acid |
| $(HOOC-CH_2-Se-)_2$ | Diselenium-diglycolic acid |
| $H-Se-CH_2-COOH$ | Selenoglycolic acid |
| $H-S-CH_2-COOH$ | Thioglycolic acid |
| 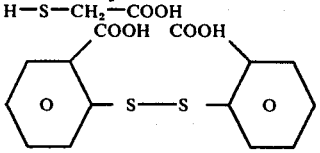 | Diphenyldisulfide-2,2'-dicarboxylic acid |
| $HOOC-CH_2-Se-CH_2COOH$ | Selenodiglycolic acid |

These compounds are known and can be produced by the known methods. Application of the nitrogen, selenium and sulfur compounds to be used according to the invention can take place in concentrations of about $10^{-8}$ to 0.5 mol/lt liquid bath, the compounds being added either alone or in a mixture.

As further additives the bath may contain the usual constituents, which are, for example, conducting salts such as ammonium sulfate or alkali salts of inorganic or weak organic acids, which as sulfuric acid, sulfurous acid, carbon dioxide, boric acid, sulfaminic acid, acetic acid or citric acid, etc., as well as pH-regulating substances, preferably the organic and/or inorganic buffer mixtures suitable for this purpose, such as disodium phosphates, carbonate, borate and acetate.

The anodic and cathodic current efficiencies of this bath are almost 100%, resulting in an extremely high stability of the bath compared with other thiosulfate-containing baths. Thus, at a load of 400 Ah/liter no adverse change in the operation of the bath is noted in two months, and the silver anodes dissolve very evenly without developing passivity phenomena.

Moreover, the coatings deposited from the bath of the invention are far superior to the precipitates separated from cyanidic electrolytes. Thus the coatings exhibit great hardness (with values $HV_{0.01}$:140 to 180 kp/mm$^2$) as well as a very good specific electric conductivity of about 40 m Ohm per mm$^2$, whereas from the cyanidic baths normally used either only precipitates of great hardness but low electric conductivity or of low hardness but good conductivity can be deposited.

Another advantage of the coatings deposited from the bath of the invention is their better wear resistance, improved by the factor of 1.5 over coatings obtained from known electrolytes.

Baths of the composition according to the invention are suitable for silverplating in engineering, especially electrical engineering, as well as for decorative purposes. Thus, for example, electric contacts, plug strips, metallized plastics and ceramic materials can be silver-plated with them to great advantage. In this application especially the remarkable electrical properties (conductivity, contact resistance) and the excellent abrasive strength at improved tarnish stability play an important role. This is significant, in particular, because more users are looking for an equivalent substitute for the ever-more expensive gold-plating.

The advantages in decorative silver-plating (jewelry, silverware, instruments) reside mainly in the remarkable luster combined with an extremely warm tone and very good ductility of these silver coatings.

Especially favorable for the economic use of the electrolyte of the invention is the fact that in addition to the above mentioned properties, it possesses also a very good dispersion capacity. This supports its universal applicability, that is, it can be used advantageously for the silver-plating of rack as well as drum ware. This holds true for baths with or without movement of the ware, permitting the use of higher current densities at increasing movement. As a rule, however, the anodic current density should expediently not exceed a value of 1.5 A/cm$^2$.

The following examples will illustrate and form part of the invention.

EXAMPLE 1

| | | |
|---|---|---|
| Silver as | $Ag_2SO_4$ | 40 g/liter |
| Sodium thiosulfate | $Na_2S_2O_3.5H_2O$ | 360 g/liter |
| Sodium pyrosulfite | $Na_2S_2O_5$ | 18.3 g/liter |
| Sodium sulfate | $Na_2SO_4$ | 20 g/liter |
| Polyethylenimine | mol.wt.>1000 | 0.08 g/liter |
| pH value 5.7 | | |
| Temperature 20–23°C | | |

Coatings deposited from this bath have high luster. The micro-hardness according to Vickers is $HV_{0.01}$ = 174 kp/mm$^2$. Analogous results are obtained with polyethylenimine (mol.wt. > 1000) and polypropylenimine (mol.wt. >1000).

EXAMPLE 2

| | | |
|---|---|---|
| Silver as | $Ag_2CO_3$ | 28 g/liter |
| Sodium Thiosulfate | $Na_2S_2O_3.5H_2O$ | 370 g/liter |
| Polyethylenimine | mol.wt.>1000 | 0.15 g/liter |
| pH value 10.2 | | |
| Temperature 25°C | | |

This electrolyte furnishes high-luster coatings. Micro-hardness according to Vickers is $HV_{0.01}$ = 160–165 kp/mm$^2$. Specific electric resistance is approximately 3.5 $\mu$ Ohm cm.

Analogous results were obtained with polyethylenimine (mol. wt. 1000) and reaction products of polyethylenimine with acetic acid anhydride or propane sultone.

EXAMPLE 3

| | | |
|---|---|---|
| Silver as | $Na_2Ag(S_2O_3)2$ | 30 g/liter |
| Sodium thiosulfate | $Na_2S_{2-3}.5H_2O$ | 250 g/liter |
| Sodium tetraborate | $Na_2B_4O_7.10H_2O$ | 20 g/liter |

-continued

| | | |
|---|---|---|
| Sodium sulfite | $Na_2SO_3$ | 20 g/liter |
| Reaction product of 1,4-dichlorobutane with tetramethylethylene diamine | | 0.2 g/liter |
| pH value 10.0 | | |
| Temperature 20–25°C | | |

The silver coatings deposited from this bath are remarkable for excellent ductility and high luster combined with extremely warm tone. The micro-hardness according to Vickers is $HV_{0.01}$ = 150–160 kp/mm², and the specific electric resistance 2.5 μOhm cm. Similar results are obtained with reaction products of 1,4-dibromobutane or 1,3-dibromopropane and tetraethylethylene-diamine or tetramethylpropylene-diamine.

EXAMPLE 4

| | | |
|---|---|---|
| Silver as | $Na_3Ag(S_2O_3)_2$ | 23 g/liter |
| Sodium thiosulfate | $Na_2S_2O_3.5H_2O$ | 105 g/liter |
| Boric acid | $H_3BO_3$ | 10 g/liter |
| Ethylene glycol | $HO—CH_2—CH_2—OH$ | 20 g/liter |
| Sodium sulfate | $Na_2SO_4$ | 25 g/liter |
| Polyvinyl pyridinium-N-sulfopropyl betaine | | 0.8 g/liter |
| pH value 5.9 | | |
| Temperature 20°C | | |

The high-luster coatings have a hardness of $HV_{0.01}$ = 140–150 kp/mm².

EXAMPLE 5

| | | |
|---|---|---|
| Silver as | AgSCN or AgCN | 20 g/liter |
| Sodium thiosulfate | $Na_2S_2O_3.5H_2O$ | 165 g/liter |
| Sodium tetraborate | $Na_2B_4O_7.10H_2O$ | 18 g/liter |
| Dipropylene triamine | $H_2N—(CH_2)_3—NH—(CH_2)_3—NH_2$ | 5 g/liter |
| Polyethylenimine | mol.wt. >1000 | 0.2 g/liter |
| pH value 8.0 | | |
| Temperature 20–30°C | | |

There result bright, ductile silver coatings. The presence of SCN ions has a favorable effect on the anodic dissolution of silver.

EXAMPLE 6

| | | |
|---|---|---|
| Silver as | $Ag_2O$ | 34 g/liter |
| Sodium thiosulfate | $Na_2S_2O_3.5H_2O$ | 375 g/liter |
| Sodium bicarbonate | $NaHCO_3$ | 10 g/liter |
| Diselenium-diglycolic acid | $(HOOC—CH_2—Se—)_2$ | 0.4 g/liter |
| pH value 9.9 | | |
| Temperature 20–23°C | | |

The bath furnishes excellently bright, ductile coatings, especially in higher current density ranges (over 1.5 A/dm2).

EXAMPLE 7

| | | |
|---|---|---|
| Silver as | $Na_3Ag(S_2O_3)_2$ | 29 g/liter |
| Sodium thiosulfate | $Na_2S_2O_3.5H_2O$ | 235 g/liter |
| Sodium tetraborate | $Na_2B_4O_7.10H_2O$ | 20 g/liter |
| Diphenyldisulfide-2,2'-dicarboxylic acid | 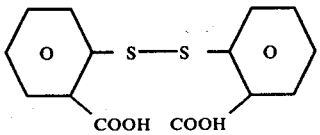 | 2 g/liter |
| Polyethylenimine | Mol.wt. 10,000 | |
| pH value 10.3 | | |
| Temperature 20–30°C | | |

Silver coatings deposited from this bath have high luster, are ductile and have a specific electric conductivity of about 40 m Ohm mm2.

EXAMPLE 8

| | | |
|---|---|---|
| Silver as | $Na_3Ag(S_2O_3)_2$ | 22 g/liter |
| Sodium thiosulfate | $Na_2S_2O_3.5H_2O$ | 110 g/liter |
| Secondary sodium phosphate | | 50 g/liter |
| Primary sodium phosphate | | 10 g/liter |
| Polyethylenimine reacted with Epichlorhydrin and quaternized with Dimethyl sulfate | Mol.wt. from 500 to 1000 | 0.75 g/liter |
| pH value 7.4 | | |
| Temperature 16–25°C | | |

The coatings deposited from this bath are remarkable especially for high hardness (over 170 kp/mm²).

EXAMPLE 9

| | | |
|---|---|---|
| Silver as | $Na_3Ag(S_2O_3)_2$ | 26 g/liter |
| Ammonium thiosulfate | $(NH_4)_2S_2O_3$ | 250 g/liter |
| Boric acid | $H_3BO_3$ | 30 g/liter |
| Ethylene glycol | $HO—CH_2—CH_2—OH$ | 60 g/liter |
| Reaction product of dipropylene triamine with epichlorhydrin | | 0.3 g/liter |
| pH value 6.3 | | |

Reaction products of tetraethylene pentamine, dimethylamino-propylamine and N,N'-bis(4-hydroxybutyrul)-tripropylene triamine with epihalohydrins give analogous results, namely high-luster coatings with a specific electric resistance of about 3.6 μ Ohm cm.

EXAMPLE 10

| | | |
|---|---|---|
| Silver as | $Ag_2CO_3$ | 30 g/liter |
| Sodium thiosulfate | $Na_2S_2O_35H_2O$ | 300 g/liter |
| Sodium sulfite | $Na_2SO_3$ | 40 g/liter |
| Sodium bisulfite | $NaHSO_3$ | 5 g/liter |
| Reaction product of 1,3-dichloropropane-2-ol with 1,8-diaminooctane | | 0.9 g/liter |
| pH value 10.2 | | |
| Temperature 20–30°C. | | |

This electrolyte furnishes bright, ductile coatings with a hardness of $HV_{0.01}$ = 150–160 kp/mm2 and a specific electric resistance of 2.1 μ Ohm cm.

I claim:

1. In a cyanide-free aqueous bath for electrodeposition of silver containing silver and a thiosulfate, the improvement which comprises the presence in said bath of at least one additive selected from the group consisting of a. an organic nitrogen compound having at least two nitrogen atoms and a molecular weight of at least 300 selected from the group consisting of polyethyleneimine, polypropyleneimine, dipropylene triamine, polyvinyl pyridinium-N-sulfopropylbetaine, polyethyleneimine reacted with epichlorhydrin and quaternized with dimethyl sulfate, a reaction product of 1,3-dichloropropane-2-ol with 1,8-diamino-octane, a reaction product of a member of the group consisting of dipropylene-triamine, tetra-ethylenepentamine, dimethylamino-propylamine and N,N'-bis(4-hydroxybutyryl)-tripropylene-triamine with epichlorhydrin, and a reaction product of a member of the group consisting of 1,4-dichlorobutane, 1,4-dibromobutane and 1,3-dibromopropane with a member of the group consisting of tetramethylethylenediamine, tetraethylenediamine and tetramethylpropylene-diamine; and b. a compound selected from the group consisting of diselenium-diglycolic acid and diphenyldisulfide-2,2'-dicarboxylic acid, said additive and compound each being present in an amount from about $10^{-8}$ to 0.5 mole per liter of bath.

2. The improvement of claim 1 wherein the nitrogen compound is the reaction product of 1,4-dichlorobutane with tetramethylethylene-diamine.

3. The improvement of claim 1 wherein the nitrogen compound is polyethyleneimine and the selenium compound is diselenium diglycolic acid.

* * * * *